United States Patent [19]
Brooks et al.
[11] 4,290,563
[45] Sep. 22, 1981

[54] METHOD AND APPARATUS FOR DISPENSING COILED MATERIALS

[75] Inventors: Dannie L. Brooks, Red Lion, Pa.; Ronald S. Fields, Manakin, Va.

[73] Assignee: Reel-O-Matic Systems, Incorporated, Wrightsville, Pa.

[21] Appl. No.: 149,718

[22] Filed: May 14, 1980

Related U.S. Application Data

[63] Continuation of Ser. No. 92,104, Nov. 7, 1979, Pat. No. 4,249,705.

[51] Int. Cl.³ ..... B21C 47/16
[52] U.S. Cl. ..... 242/78.6
[58] Field of Search ..... 292/78.6, 78.7, 78.8

[56] References Cited

U.S. PATENT DOCUMENTS

| | | | |
|---|---|---|---|
| 3,162,394 | 12/1964 | Culpepper | 242/78.6 |
| 3,244,380 | 4/1966 | Hoyne | 242/78.6 |
| 3,512,728 | 5/1970 | Johnson | 242/78.6 |
| 3,810,591 | 5/1974 | Haven | 242/78.6 |
| 3,933,322 | 1/1976 | Satzinger | 242/78.6 |
| 4,249,705 | 2/1981 | Brooks | 242/78.6 |

*Primary Examiner*—Edward J. McCarthy
*Attorney, Agent, or Firm*—J. Gibson Semmes

[57] ABSTRACT

Method and apparatus for dispensing flexible materials from multiple coils which are stacked in coaxial alignment upon a rotatable turntable so that the open inner eye of each coil is vertically oriented. For dispensing, the top most coil is clamped between a snubber roll on the outer periphery, and an expandable core which is positioned within the inner eye and activated to provide gripping engagement therewith. Since the expandable core is flexible, it conforms to the shape of the inner eye, thus readily adapting the invention for use with coils which are noncircular or irregularly formed. In a preferred form, the expandable core and snubber roll are coactively connected components of the floating arm assembly which is completely separable from both the turntable and the pay-out assembly. As thus constructed, the floating arm assembly drifts horizontally to follow the irregular motion resulting from rotation of off-centered coils.

14 Claims, 4 Drawing Figures

METHOD AND APPARATUS FOR DISPENSING COILED MATERIALS

CROSS-REFERENCE TO RELATED APPLICATIONS

This is a continuation-in-part of application Ser. No. 092,104, filed Nov. 7, 1979, now U.S. Pat. No. 4,249,705.

BACKGROUND OF THE INVENTION

Strips of metal, such as may be later formed by stamping, are coiled into what are commonly termed mults. The current art is known to employ means for dispensing slit mults which have been coaxially attached to one another by means of tabs. In the art, such a cluster of coils is provided with a removable but fixed center core which engages all the mults and a horizontal mandril. This is called eye horizontal dispensing. The uncoilers may be driven or nondriven. Upon rotation of the cluster, peeling of the strips from the mults is effected by a combination knife assembly which has the effect of detaching the strip of one mult from another, during the dispensing of the strip. Because of the requirement of a preset core, overhead cranes are required to set such clusters of coils upon an overhung mandril, eye horizontal, prior to strip dispensing. This handling often results in damage to a given cluster of mults; moreover, such systems do not satisfactorily compensate for distortionally formed or asymmetric clusters of mults. Again, in the handling thereof, time-consuming placement and replacement of the adjustable center core is required, often in an effort to correct the distortion without wholly reforming the cluster of mults. Such present day methods of handling of multiple mults of strip materials are additionally such as to make it difficult in cramped quarters to present the materials substantially horizontally to the press line where the strips are cut, formed, or shaped.

With these deficiencies in mind, each resulting in costly and time-consuming handling, the invention has as its objectives the most expeditious handling of coiled strips within the metes and bounds of modern day technology. Whereas the invention is described in terms of handling flat coiled metal stock, it is equally useful in the controlled dispensing of other stock having variant cross section configuration and composition characteristics and wherein multiple coils are stacked upon one another for ease of storage and transfer by lift truck and pallet. The invention in its broadest aspects successfully addresses the dispensing of coiled flexible materials, stacked into mults without attachment to one another.

SUMMARY OF THE INVENTION

The invention in its broadest aspect comprises method and means for efficiently dispensing various flexible strands of coiled materials such as sheet material, wire, cable and the like, coiled strips of film, and/or tape, be they plastic or metal but wherein the coiled strands or strips are stacked upon one another. The primary objective is accomplished by placing a stack or cluster of coils of such material upon a turntable, eye-to-the-sky, selectively confining the topmost coil by clamping, and driving the turntable while the material is peeled and dispensed.

The topmost coil is clamped by conformably engaging the inner eye thereof with an expandable core while simultaneously engaging the outer periphery thereof with a snubber roller. In a refined form, the expandable core includes a flexible pneumatic cushion which readily conforms to, and grips, coils having variously shaped inner eyes. The invention is thus well adapted for dispensing coils which are noncircular, which have been irregularly formed, or which have been distorted during prior handling. For some coiled materials, inflation of the pneumatic cushion will effect a rounding out, or reshaping, of the coil, thus further facilitating dispensing by providing a more balanced load for the turntable.

Unlike the clamping system of the parent case hereof, application Ser. No. 092,104, filed Nov. 7, 1979, now U.S. Pat. No. 4,249,705, the floating arm assembly of the present invention is not interconnected with nor fixed in relation to the turntable or the support structure for the pay-out assembly. Rather, the expandable core and snubber roll are included components of a separate floating arm assembly which is free to float, or drift horizontally, to track any irregular motion of the coils during rotation. This improved feature accordingly provides automatic compensation for misaligned, off-centered, or irregular coils.

In a preferred form, the snubber roll and expandable core are coactively interconnected through an adjustable pneumatic cylinder which permits clamping with a uniform radial compression while an entire coil is dispensed. Since the pressure can be readily preselected and controllably maintained, softer materials can be dispensed without danger of distortion or damage thereto. As well, highly resilient materials, such as those used in the manufacture of springs, can be securely confined during the entire dispensing procedure.

Noteworthy is the eye-to-the-sky or upright disposition of the cluster of coils wherein the respective mults of the cluster are unconfined, except for the clamping or compression effect between the snubber roll and the expandable core. These elements are easily positioned, thus eliminating the cumbersome task of installing the known multiple coil center cores. The strip is thus passed through a fixed carriage to reverse direction, thence passed over gate and dancer rolls where speed control is effected, commensurate with the requirement of a treatment line. Where the coils forming the cluster are bonded together by means of conventional tab and the like, the bonds are broken by the peeling action of a uniquely mounted knife assembly. Details of the invention will be apparent from reference to the ensuing drawings.

DESCRIPTION OF THE PREFERRED EMBODIMENT

Figure 1:
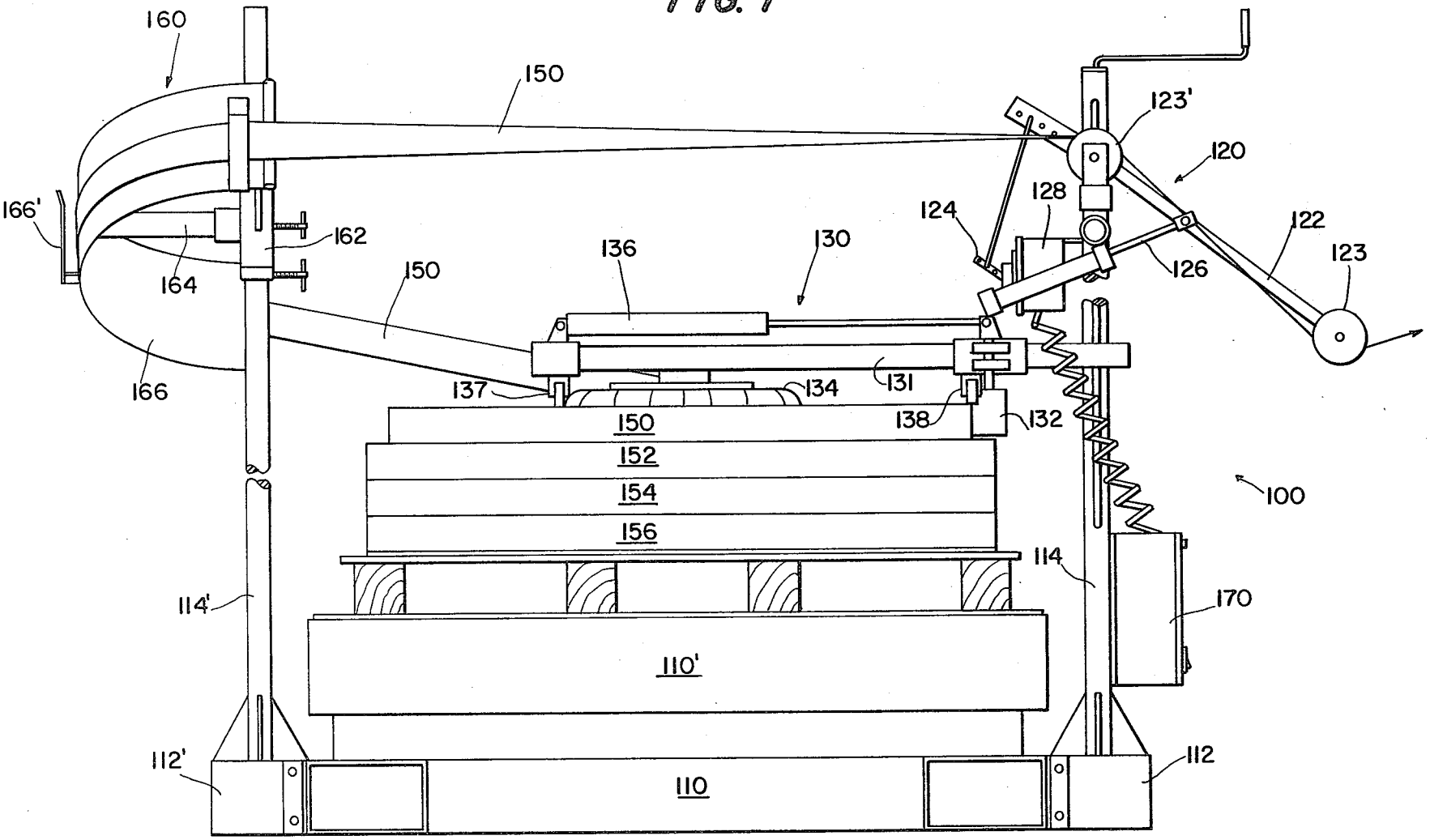
FIG. 1 is a view in side elevation of apparatus in accordance with the invention.
Figure 2:
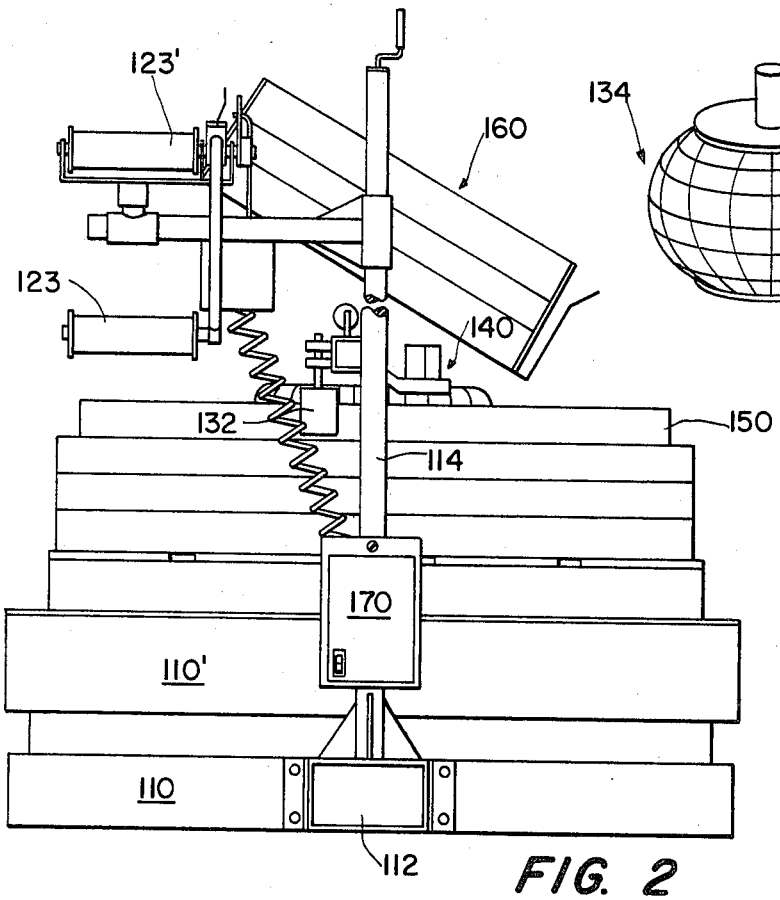
FIG. 2 is an end elevation of the apparatus shown in FIG. 1.
Figure 3:
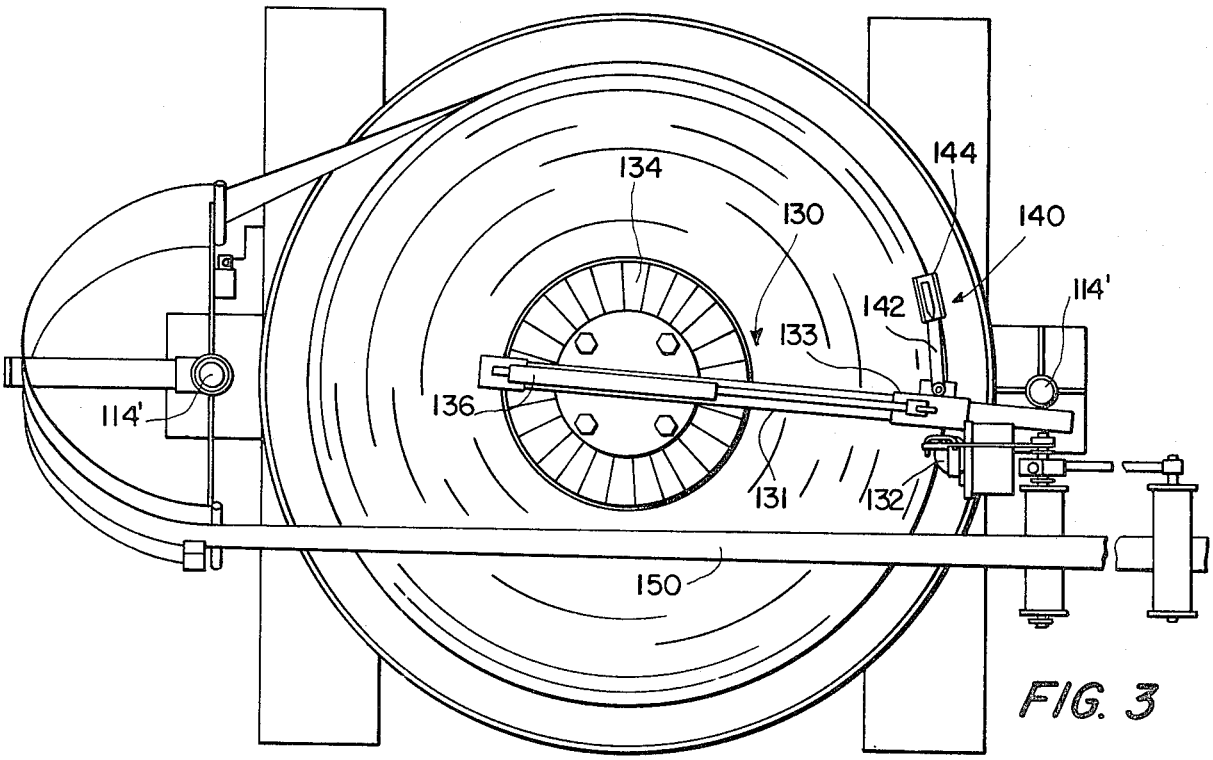
FIG. 3 is a top plan view of the apparatus of FIG. 1.

A preferred form of the invention is illustrated in FIGS. 1–3, inclusive. In this embodiment, the apparatus 100 is adapted to dispense multiple slit metal strips which are stacked on one another to form an enlarged coil. The respective coils may be secured to one another in coaxial alignment by conventional tabs, not shown.

This is commonly known as a cluster coil. Turntable base 110 secures at its outer extremities the extensions 112–112', each anchoring opposed vertical posts 114 and 114' at opposite ends of the device. The turntable base 110 is adapted to support the powered turntable 110' upon which may be placed a pallet carrying the plural coils, or mults, of a given slit strip material. The topmost mult 150 comprises the threaded strip which is being dispensed as shown in FIG. 1. The second, third and fourth mults of the shown cluster coil bear the numerals 152, 154, 156, respectively. As indicated, the vertical posts are fixed relative to the powered turntable, post 114 having a telescopic extension which is adapted to vertical adjustment by hand or powered crank interconnection in order to raise and lower the elements 120 relative to the press, or materials processing, line, not shown.

A floating arm assembly, or mult clamping system, 130 is best shown in FIGS. 1 and 3, wherein it will be noted that snubber roll 132 and expandable core 134 have adjustable interconnection through pneumatic cylinder 136. Snubber roll 132 is journalled to sleeve 133 for rotation about an axis which is generally parallel to the axis of rotation of turntable 110'. As can be seen, actuation of pneumatic cylinder 136 exerts a pulling force upon sleeve 133, urging the same to travel linearly along horizontal arm 131. This effects an inwardly directed force upon topmost mult 150 by snubber roll 132. As shown in the drawings, expandable core 134 is in gripping engagement with the open inner eye of the topmost coil 150. Since core 134 also has fixed axial connection with horizontal arm 131, a compressive clamping force is applied in a radial direction along an imaginary line connecting the rotational axis of snubber roll 132 with the expandable core rotational axis 135'. Pneumatic cylinder 136 is adjustable and may be preset using conventional techniques to yield a uniform clamping effect during the entire dispensing process. Guide rolls 137 and 138 have pivotal connection with horizontal arm 131 and are provided to support and position the horizontal arm assembly in relation to the topmost coil 150. It will be appreciated that the arrangement of these guide rolls minimizes the weight which the expandable core 134 must bear. Guide roll 138 additionally functions to position the snubber roll for proper height and to position the peeling blade assembly 140.

The horizontal arm assembly 130 has no fixed interconnection with either the turntable or the support system which includes post 114 and 114'. Rather, it is a completely separable and independent assembly which has only operational coactive relationship to the remaining elements shown in the drawings. Once expandable core 134 has been activated to engage the inner eye of coil 150, rotation of the turntable forces contact between horizontal arm 131 and vertical post 114. Core 134 continues complimentary rotation with the coil while horizontal arm 131 is fixed. The operational effect of this is to substantially define the points through which radial compression is applied to the coil. Arm 131 is free to move horizontally with respect to vertical post 114 so that the entire floating arm assembly can drift to follow the irregular motion resulting from nonuniform or off-centered coils. It will be appreciated that means other than a vertical post could be employed to fix the horizontal arm assembly while still obtaining the objectives above noted.

Figure 4:
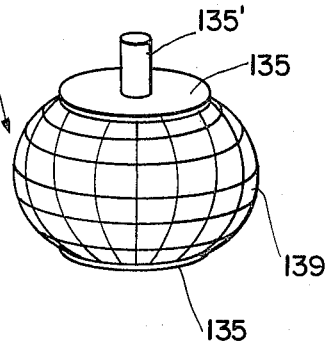
FIG. 4 is a view in perspective of a preferred form of the expandable core.

FIG. 4 shows a preferred form of expandable core 134. A flexible pneumatic cushion 139 is in sealed concentric disposition about an inner rim, or rigid retainer, 135. Pressurized air introduced into the cushion by means (not shown) expands the same outward to effect the gripping engagement with the inner eye of a coil. In a presently preferred form, this expandable core may be an adapted air spring of the type manufactured by the Goodyear Tire & Rubber Co., as detailed in that company's 1979 publication entitled "Super-Cushion Air Spring Engineering Manual". It is to be noted, however, that the invention encompasses any type of expandable core which may be conformed with the inner eye of coils, symmetrical or irregular. Thus, materials other than the high-strength rubber/fabric flexible air containers utilized in the aforementioned air springs may be employed with equally satisfactory results. It is necessary only that the core utilized permit, in addition to conforming with the shape of the eye, application of a clamping force to a coil. The relative dimensions for core 134 and its components will necessarily depend upon the dimensions of the particular coil being dispensed. Where tab-secured cluster coils are being dispensed, it is advantageous to employ a core which is sufficiently long to grip the topmost coil and the coil next adjacent thereto. This construction will assure complementary rotation of the two attached coils. In other applications it may be necessary to employ a core which will be sufficient to grip only the topmost coil, or to grip a plurality of coils.

The clamping action of the floating arm assembly 130 will insure stable positioning of the cluster of coils upon turntable speeds of 0–130 fpm, the normal rate of speed to a conventional press-line. Imperfections in a clamped coil are readily accommodated by this floating arm assembly so that the stability of positioning extends not only to the topmost coil, but to the coils beneath.

As shown in FIGS. 2 and 3, the peeling blade assembly 140 has pivotal connection with sleeve 133 of the horizontal arm assembly. As seen most clearly in FIG. 3, one end of trailing arm 142 shares a common axis with guide roll 138. At the other end of trailing arm 142 a blade 144 is mounted upon a pivot which is in axial alignment with the knife edge of the blade. This peeling blade assembly is provided for use with tab-secured cluster coils. Where the coils are independent of each other and not secured together, no peeling means are required to affect dispensing.

Elements 120 forming in part the dancer arm and speed control, may be shifted vertically independently of the floating arm assembly. In operation, it is desirable that gate roll 123' be at substantially the same height as the press-line which is served by the apparatus 100. The axis of gate roll 123' forms a pivot about which the interconnected dancer roll 123 moves under the restraint of the air-assisted dancer 126. See FIG. 1. As there shown, the dancer arm bell crank extension 124, serving via suitable pot means 128 to signal an SCR controller 170, the latter having interconnection with the motive means. Thus the press-line draw speed determines speed control of the powered turntable 110', all in accordance with the demands of the press-line or other processing system.

A tiltable basket assembly 160 having a coated slide to extend life and to reduce friction is mounted upon the vertical post 114'. This basket includes a vertically adjustable connector 162, a support arm 164 with an arcuate slide 166 to which are attached plural strip retainers 166'. To effect a 90° turn of the strip 150 it will be noted from FIG. 2 that a tilt of substantially 30° to the basket assembly will result in a composite 90° rotation being applied to the strip which is being dispensed from the coil over the gate roller 123' and under the corresponding dancer roll 123. Attached to the interconnecting linkage 122 of the respective gate and dancer rollers is an optionally available air-assisted dancer 126.

Whereas the invention has been described with reference to the dispensing of slit strips, which have been stacked and attached to form a unitary coil, the invention is not so limited, as it will apply equally as well to the dispensing of any coiled materials such as wire, film, tape and the like.

I claim:

1. A method of dispensing flexible material from unconfined coils, each coil having an open inner eye, a method comprising the steps of:

(a) setting at least one coil upon an upright turntable;

(b) conformably engaging the inner eye of said coil with an expandable core; and, concurrently therewith, (c) engaging the outer periphery of said coil with a roller to apply radial compression thereto;

(d) drawing the flexible material from said coil.

2. The method according to claim 1, wherein said step (c) includes applying predetermined radial compression and wherein said step (d) includes maintaining said predetermined radial compression while drawing the flexible material.

3. The method according to claim 2, further including the step of:

(e) activating the turntable while automatically controlling the speed thereof commensurate with a given drawing demand of a flexible material processing line.

4. The method according to claim 1, further including the step of:

(f) concurrently with step (e), peeling the flexible material from the said coil with a blade disposed adjacent the outer periphery of said coil.

5. The method according to claim 4, further including the step of:

(e) activating the turntable while automatically controlling the speed thereof commensurate with a given drawing demand of a flexible material processing line.

6. The method according to claim 5, further including the step of:

(h) sequentially to peeling step (f), rotating the flexible material through a predetermined angle.

7. The method according to claims 1, 2, 3, 4, 5, or 6, wherein said step (a) includes setting a coaxially aligned stack of multiple coils upon said turntable, and wherein said step (b) includes simultaneously engaging the inner eye of at least the topmost coil.

8. The method according to claim 1, 2, 3, 4, 5, or 6, wherein said step (a) includes setting a coaxially aligned stack of multiple coils upon said turntable, and wherein said step (b) includes simultaneously engaging the inner eye of the topmost coil and the inner eye of at least the next adjacent one of said coils.

9. The method according to claim 8 wherein said stack of multiple coils comprises a cluster of multiple slit mults, adjacent mults thereof being tab-secured to one another.

10. Apparatus for dispensing flexible materials from coils, each coil having an open inner eye, comprising:

(a) rotary turntable supporting at least one coil, the eye of said coil being vertically disposed;

(b) a floating arm assembly disposed above and apart from said turntable, said floating arm assembly including an expandable core disposed within the inner eye of the topmost coil, said core being conformable to the shape of said inner eye for gripping engagement therewith, said floating arm assembly further including a snubber roll, said snubber roll being engagable with the outer periphery of said coil, said snubber roll and said expandable core being coactively connected to apply radial compression to said coil;

(c) means to activate the turntable.

11. The apparatus according to claim 10, wherein said floating arm assembly further includes adjustable pressure means coactively connected to said snubber roll for applying a predetermined radial compression to said coil.

12. The apparatus according to claim 11 wherein said pressure means comprises a pneumatic cylinder.

13. The apparatus according to claim 12 wherein said expandable core comprises a flexible pneumatic cushion in sealed disposition about a rigid retainer.

14. The apparatus according to claim 10, 11, 12, or 13, wherein said rotary turntable supports a stack of multiple coils, the eye of each of said coils being vertically disposed and wherein said expandable core is further disposed within the inner eye of at least the next adjacent one of said coils, said core being conformably engagable with the inner eye of said next adjacent coil.

* * * * *